United States Patent [19]

Swanke et al.

[11] 3,974,952

[45] Aug. 17, 1976

[54] WEB TRACKING APPARATUS

[75] Inventors: Thaddeus Swanke; Michael S. Montalto; John E. Morse, all of Rochester, N.Y.

[73] Assignee: Eastman Kodak Company, Rochester, N.Y.

[22] Filed: Sept. 10, 1974

[21] Appl. No.: 504,771

[52] U.S. Cl. ..... 226/189; 226/196

[51] Int. Cl.[2] ..... B65H 23/02

[58] Field of Search ..... 226/15, 18, 21, 196, 226/198, 199, 189

[56] References Cited

UNITED STATES PATENTS

| | | | |
|---|---|---|---|
| 3,315,859 | 4/1967 | Owen | 226/21 |
| 3,507,437 | 4/1970 | Lips | 226/196 |
| 3,658,227 | 4/1972 | Stephens | 226/196 |
| 3,776,442 | 12/1973 | Ridley | 226/199 X |

*Primary Examiner*—Richard A. Schacher
*Attorney, Agent, or Firm*—J. S. Mathews

[57] ABSTRACT

Web tracking apparatus for a flexible, closed loop web moving in a closed loop path defined by two or more cylindrical, hard surface supports mounted on a frame and having substantially parallel longitudinal axes which are substantially perpendicular to a plane passing through the respective midpoints of the supports. Included are at least two laterally constraining web supports, at least one of which is a passive positional lateral constraint and includes a cylindrical web-engaging surface which presents substantially no resistance to lateral movement of the moving web, and edge guides mounted adjacent to the cylindrical surface in a predetermined spatial relation to the frame, and having spaced web engaging portions fixed a distance apart which corresponds substantially to width of the web for engaging the edges of the moving web.

14 Claims, 11 Drawing Figures

WEB TRACKING APPARATUS

CROSS REFERENCE TO RELATED APPLICATIONS

Reference is hereby made to commonly assigned and copending U.S. Pat. application Ser. No. 504,777, entitled WEB SUPPORT WITH CASTERED AND GIMBALLED ROLLER, filed on even date herewith in the name of John Edwin Morse. Reference is also made to commonly assigned and copending U.S. Pat. application Ser. No. 504,778, entitled POSITIONALLY CONSTRAINING WEB SUPPORT, filed on even date herewith in the names of Thaddeus Swanke and Richard Thomas O'Marra.

BACKGROUND OF THE INVENTION

1. Field of the Invention

This invention relates generally to a web tracking apparatus, and more specifically to the tracking of a flexible web moving in a closed loop path defined by two or more hard surface cylindrical supports.

2. Description of the Prior Art

A web tracking apparatus for tracking a flexible, unidirectionally moving web in a closed loop path on hard surface, cylindrical web supports comprise basically two types of web supports if defined in terms of function rather than structure. That is, as the moving web approaches a web support, the entering web "sees" the support, relative to a fixed frame, either as (1) a laterally constraining support, or (2) a laterally non constraining support. A laterally constraining support may be further subdivided into (a) an angular lateral constraint in which the entering web is constrained against changing its lateral position relative to the frame except as its angular position changes relative to the fixed frame, and (b) a positional lateral constraint in which the entering web is constrained against changing its spatial lateral position relative to the frame, while remaining free to change its angular position. The web entering a non constraining support, on the other hand, is free to change either its angular or its spatial lateral position relative to the frame without experiencing substantial lateral forces.

Whether a particular web support is a laterally constraining or laterally non constraining support depends as much on its function in the tracking apparatus as on its structure. For example, a fixed axis, rotating, cylindrical roller, such as an idler roller or a drive roller in a tracking apparatus, is structurally an angular lateral constraint capable of constraining the moving web against change in its lateral position. To perform as an angular lateral constraint, the entering web has to be capable of tracking on the rotating cylindrical surface until the moving web and the rotating surface are in alignment; i.e., until the longitudinal axis of the rotating surface is perpendicular to the direction of travel of the web. This tracking phenomenon is due to frictional forces developed between the moving web and the rotating surface, which in turn are a function of, among other variables, wrap angle, web tension, and the upstream web-span to web-width ratio. Thus, if the wrap angle, for example, is insufficient to create the frictional forces necessary for tracking, the entering web is free to change its angular position and/or its lateral spatial position, without experiencing substantial lateral forces resulting in a web support that is functionally non constraining, although structurally an angular lateral constraint.

Although the above-noted variables upon which tracking depend are usually parameters which are governed by the design of the web tracking apparatus, some generalities can be stated that cover a significant number of situations. Thus, for a flexible closed loop web supported by hard surface cylindrical supports, the upstream web-span to web-width ratio should be somewhat equal to or greater than one, and the wrap angle should range between aproximately 30° and 135°, depending on the coefficient of friction of the surfaces in contact, and on web tension. If otherwise, the web could be prevented from tracking, either because of not enough, or too much contact with the web support.

To facilitate the discussion to follow, it will be convenient to refer to a laterally non constraining support, as defined above, as an "N" support, and to refer to a laterally constraining support as a "P" support if it is functionally a positional lateral constraint as defined above, and as an "A" support if it is functionally an angular lateral constraint, also as defined above.

In designing a closed loop web tracking apparatus of the type discussed above, one of the primary considerations of the design is lateral stability of the moving web. Generally, stability of the moving web is achieved if the tracking apparatus has at least two laterally constraining supports, at least one of which is further restricted to be a P support; the remaining web supports, if any, in the tracking apparatus can be either laterally constraining supports (P or A) or non constraining supports (N) as dictated by design considerations.

Although the stability principle stated above will ensure stability of the moving web, it does not, without more, ensure uniformity of tension in the moving web. Nonuniformity in tension ordinarily results from imperfections in the manufacture of webs and web supports, and from the lack of perfect parallelism in the longitudinal axes of the mounted web supports. It follows that if manufacturing tolerances are minimized and the supports are mounted with a high degree of parallelism, a degree of uniformity of tension will be achieved. However, such considerations are independent of the stability principle.

If a high degree of uniformity of tension of the web is a requisite of the tracking apparatus design, it can be achieved with little regard to manufacturing or mounting tolerances by conforming the web tracking apparatus to what will be referred to as the uniformity of tension principle. This second web tracking principle dictates that the moving web exiting from a first laterally constraining support must be given freedom, once and only once, to change direction before entering a second laterally constraining support. This freedom is given to the exiting web by "gimballing" the first web support; i.e., by mounting the first web support for pivotal movement about a gimbal axis which is parallel to the direction of linear movement of the entering web, and which intersects the longitudinal axis of the support at the midpoint of the support. If for design considerations it is impracticable to gimbal the first constraining web support, e.g., if it is a drive roller, the uniformity of tension principle can be met by gimballing a non constraining web support mounted between the two constraining web supports.

The gimbal action of the web support, i.e., the capability of the exiting web to change direction, enables the exiting web to compensate for non uniformity of tension of the web in the downstream web span. The resultant force of the non uniform tension across the exiting web is at some perpendicular distance from the centerline of the moving web; the component of that resultant force which is perpendicular to the gimbal axis creates a moment about the gimbal axis which varies with the sine of the wrap angle, since the magnitude of the force component perpendicular to the gimbal axis varies with the sine of the wrap angle. For example, for wrap angles approaching zero or 180° the magnitude of the force component approaches zero and therefore, the exiting web is not free to change direction.

It is clear from the above relationship that the magnitude of the force component perpendicular to the gimbal axis is greatest for a wrap angle of 90°; moreover, as the wrap angle increases appreciably from 180° the exiting web behaves as if the wrap angle were appreciably greater than zero. While the gimbal action may not be appreciably inhibited by large wrap angles (e.g., those appreciably less than 180° and especially those appreciably greater than 180°), such large wrap angles may inhibit the tracking action of a web support, thereby possibly producing an unstable tracking apparatus.

The "once and only once" requirement of the uniformity of tension principle can be illustrated by theorizing a tracking apparatus in which the web exiting from a P or A support encounters two N supports before entering a second laterally constraining support. The "once and only once" requirement provides that only one of the three supports encountered by the moving web before reaching the second constraining web support (the first laterally constraining P or A support, the first N support, or the second N support,) be gimballed; the other two must prevent the exiting web from changing direction. For reasons noted above, gimballing one of the supports provides uniformity of tension in the downstream web without affecting lateral stability. However, if more than one support is gimballed before the web enters a second lateral constraint, the lateral position of the web at the second and any subsequent non constraining gimballed supports, becomes unstable and indeterminate. The result could be lateral instability of the web span between the first gimballed support and the second constraining web support, and possible edge damage to the moving web due to such instability. Thus, the "once and only once" requirement ensures lateral stability in the moving web when N supports are utilized in a tracking apparatus, while providing uniformity of tension.

Theoretically, the above principles would not be violated by a two-support, closed loop web tracking apparatus. However, technical problems such as the gimballing of a drive roller to meet the "once and only once" requirement, and wrap angle considerations upon which the gimballing action depends, as well as practical problems such as utility for such a two-support apparatus, could make such an apparatus commercially unattractive. On the other hand, if uniformity of tension in the web is not crucial in the design of the tracking apparatus, a tracking apparatus comprising two laterally constraining supports, at least one of which is a P support in conformance with the stability principle outlined above, will provide a laterally stable web tracking apparatus. A measure of uniformity of tension in the web will be maintained if manufacturing and mounting tolerances are kept at a minimum, notwithstanding the violation of the "once and only once" principle outlined above. In such an apparatus, gimballing the two supports would not provide the necessary gimballing action since the wrap angle of one or both laterally constraining supports would be, in practice, about 180°. The introduction of additional supports to a closed loop web tracking apparatus, however, eliminates the technical and practical problems discussed above if the combination of supports conforms to the two tracking principles outlined above, and their location relative to each other is such that the respective wrap angles the moving web makes with the three or more supports are within the limits previously discussed.

Structurally, the art discloses a variety of individual web supports which are the functional equivalent of the basic supports outlined above. For example, the art discloses laterally constraining supports of the P type which can be placed in two categories: (1) "active" P supports, and (2) "passive" P supports. The active category includes servo controlled steering rollers in which lateral position of the web is maintained by an external mechanism which senses the misalignment of the web and triggers a compensating mechanism to return the moving web to its aligned position. The external sensing mechanism can be mechanical, electrical, or pneumatic and generally has the economic disadvantage of being complex and expensive. There is also the added practical disadvantage of lateral web oscillation, however tolerable, between the aligned and the sensed misaligned position.

The passive category of P supports includes castered and gimballed rollers having edge guides which are fixed in a predetermined position relative to a fixed frame, and are fixed a distance apart which corresponds substantially to the width of the moving web. Hence, the edge guides fix the lateral spatial position of the moving web at the roller.

Non constraining N type supports disclosed by the art include low friction cylindrical non rotating surfaces, axially compliant rollers, as well as cylindrical rollers mounted for pivotal movement about a castering axis which is perpendicular to the plane of the entering web and which intersects the centerline of the moving web at an upstream location, such as that disclosed in copending application Ser. No. 504,777. The non constraining action of a castered roller is dependent upon the tracking phenomenon discussed above in connection with a fixed axis, angularly constraining roller, and is dependent upon the same variables (i.e., wrap angle, etc.). In the case of the angular laterally constraining support the web aligns itself perpendicular to the fixed axis, and thereby its lateral position becomes fixed. However, in the case of the non constraining castered roller, the roller aligns itself to the moving web, thereby giving the web freedom to change either its angular or spatial lateral position.

The art discloses closed-loop web tracking apparatus of hard surface cylindrical rollers supporting flexible moving webs. Such tracking apparatus depend on servo controlled steering rollers to provide the necessary lateral control of the moving web and, as such, may be called active web tracking apparatus. Besides the servo controlled P support, these unidirectional devices also include a drive roller by which longitudinal movement in the closed loop path is imparted to the closed loop web, and which constrains the moving web angularly against change in its lateral position. It is seen, then, that active tracking apparatus can conform to the stability principle of web tracking. As previously noted, however, these devices have economic and practical disadvantages. Such disadvantages can be overcome by a passive P support, which, as used herein, is defined as an apparatus free of misalignment sensing and compensating mechanisms, such as a servo controlled steering roller.

Accordingly, it is an object of the invention to provide a web tracking system for the accurate tracking of a flexible, closed-loop web that is mechanically simple and reliable, and independent of external misalignment sensing mechanisms.

It is another object of the invention to provide a web tracking system wherein the tension distribution in the closed-loop web is uniform and the moving web is positionally stable.

It is a further object of the invention to provide a web tracking apparatus that is self compensating for variations in web dimensions and stiffness, and parallelism tolerances in the longitudinal axes of the web supports.

SUMMARY OF THE INVENTION

These objects are accomplished by the present invention by providing a passive web tracking apparatus for a flexible, closed loop web moving in a path defined by two or more cylindrical, hard surface supports mounted on a fixed frame with substantially parallel longitudinal axes which are substantially perpendicular to a plane passing through the respective midpoints of the supports. The tracking apparatus includes at least two laterally constraining web supports for imparting lateral stability to the moving web, at least one of the web supports being a positionally constraining web support. The positionally constraining support includes edge guides which are mounted in a predetermined spatial relation to the frame and have spaced opposed web engaging portions which are fixed a distance apart which corresponds substantially to the width of the web and which engage the edges of the web. A web supporting surface located between the web engaging portions is mounted to present substantially no resistance to lateral movement of the entering web.

In one embodiment of the invention, the web tracking apparatus includes two laterally constraining web supports, one of which is a passive positional constraint, the other of which is a drive roller, and one non constraining web support. The positional lateral constraint, located upstream from the drive roller, includes a castered and gimballed roller with annular flanges mounted a fixed distance apart and in a predetermined spatial relation to a fixed frame, the fixed distance between the flanges corresponding substantially to the width of the web. The non constraining web support, located downstream from the drive roller, includes a castered and gimballed, spring biased roller for laterally decoupling the web exiting from the upstream angular constraint (the drive roller) so that the web exiting from the non constraining support is free to change direction, thereby providing uniform tension in the web span.

The invention and its objects and advantages will become more apparent in the detailed description of the preferred embodiments presented below.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
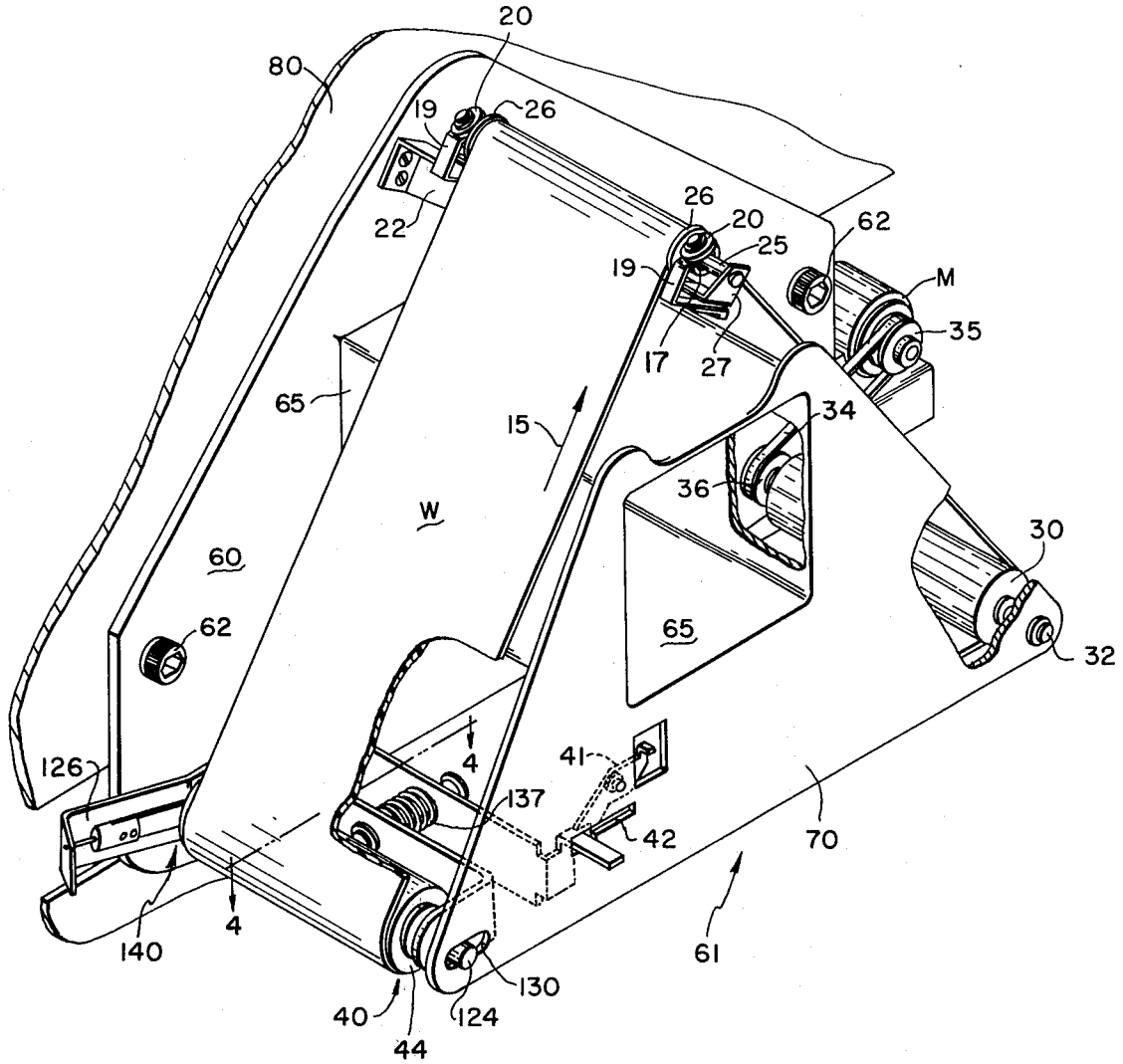
FIG. 1 is an isometric view of a web tracking apparatus embodying the present invention, showing a passive, positionally constraining web support; an angularly constraining web support; and a non constraining web support.

Referring now to the drawings wherein like reference numerals have been used in the several views and figures for like elements, FIG. 1 illustrates a subframe 61 made up of a back plate 60, a front plate 70 and a rectangular connecting member 65. Mounted on the subfame are two laterally constraining web supports, one of which is a passive positionally constraining web support 20, i.e., a P support, the other of which is an angularly constraining web support 30, i.e., an A support, and a non constraining web support 40, i.e., an N support. The surfaces of web supports 20, 30 and 40 define a closed-loop path for web W moving in the direction indicated by arrow 15. Subframe 61 is mounted on the main machine frame 80 by bolts 62.

Figure 2:
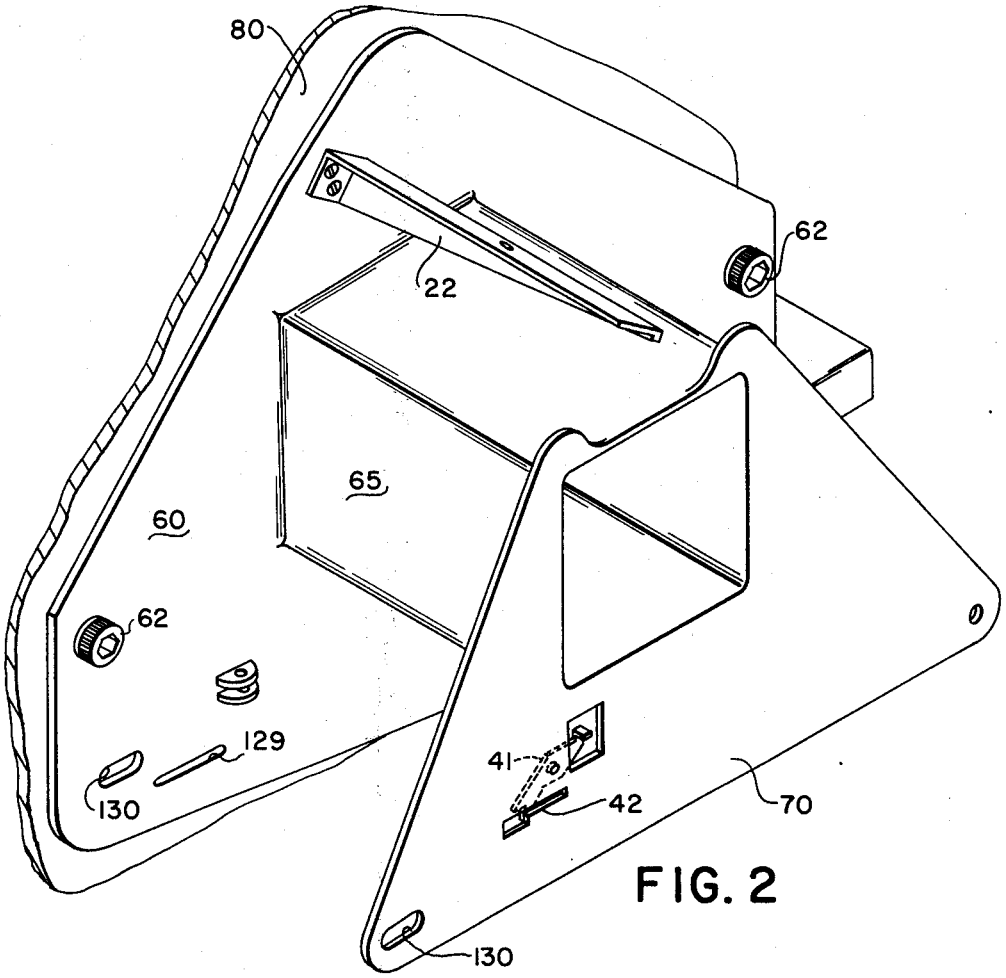
FIG. 2 is an isometric view of the subframe of the web tracking apparatus shown in FIG. 1.
Figure 3A:
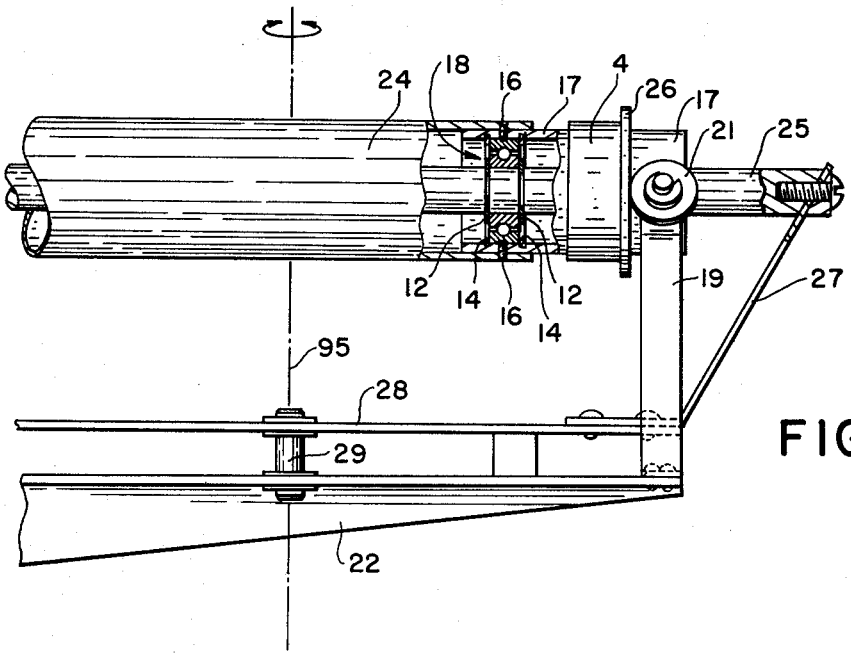
FIG. 3*a* is a cross-section, fragmentary view of the web support shown in FIG. 3.
Figure 3:
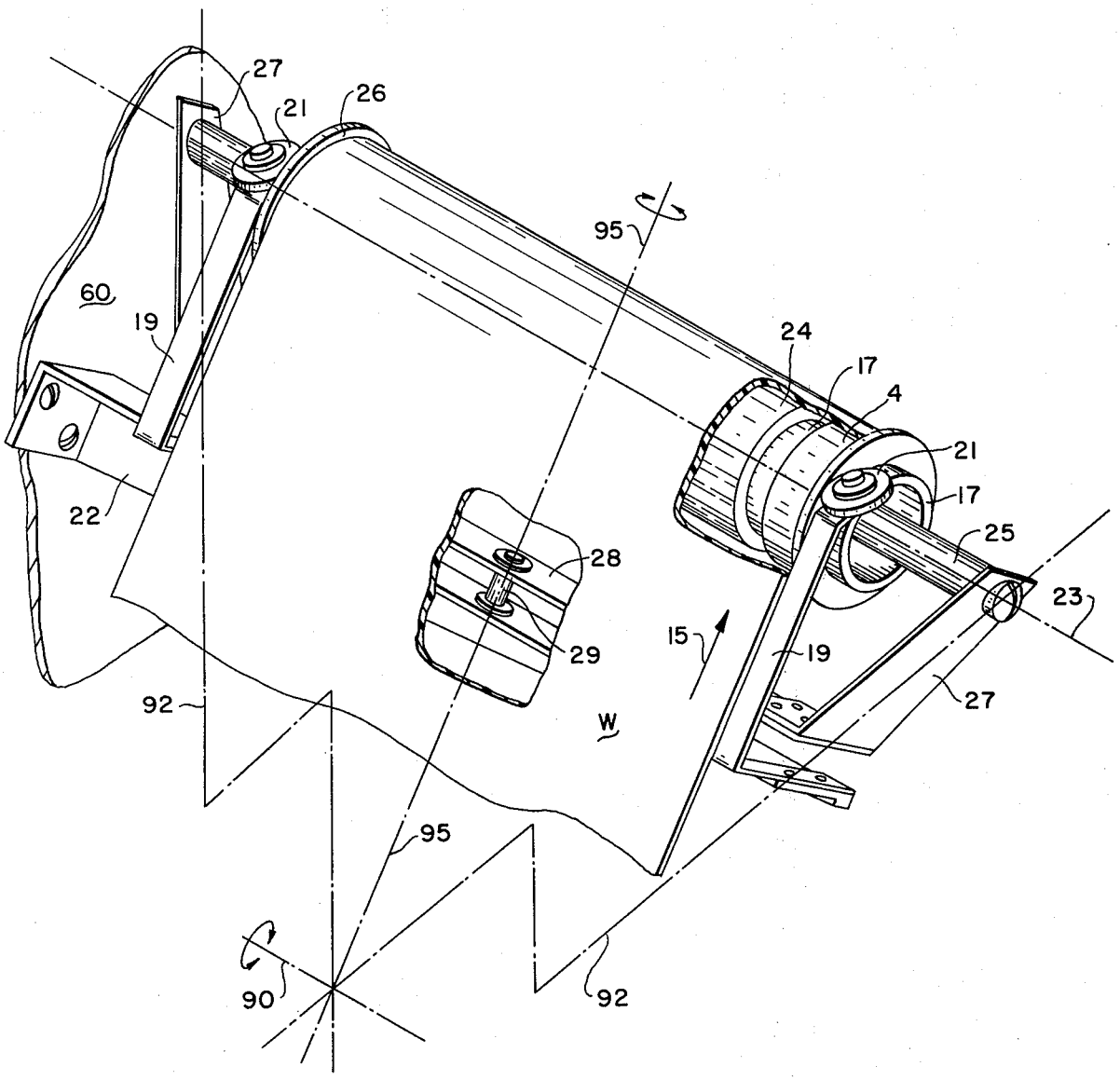
FIG. 3 is an enlarged, isometric, partly cut-away view of the passive, positionally constraining web support shown in FIG. 1.

As seen more clearly in FIGS. 1 and 2, web support 20 is mounted on cantilever beam 22 which is bolted onto back plate 60. Turning to FIGS. 3 and 3*a*, it is seen that cylindrical roller 24 is a hollow tube having connected at each of its two ends, by pins 16, an inner sleeve 17, which, in turn, is fixedly mounted to the outer ring of roller bearing 18 by retaining rings 14. The inner ring of bearing 18 is fixed to shaft 25 by retaining rings 12. Shaft 25 is connected to one end of side flexure members 27; the other end of members 27 are fixedly mounted to pivoting bar 28 which pivots about gimbal axis 95 at pin 29. Gimbal axis 95 is parallel to the entering web W. Flexure members 27 are mounted at an angle such that their respective centerlines 92 lie in a plane parallel to the plane of the entering web W in FIG. 3, and intersect upstream of web support 20. The intersection of centerlins 92 define the castering axis 90, perpendicular to the plane of the entering web W, about which shaft 25, and the rotationally mounted roller 24, pivot.

Annular flanges 26 have a cylindrical part 4 which has an outside diameter equal to that of roller 24. The flanges are mounted on sleeves 17 for independent axial and rotational movement from roller 24. The maximum inside distance between flanges 26 is substantially equal to the width of the web W and is retained constant by limiting wheels 21 which are mounted for rotational movement, on one end of cantilevered member 19, to reduce friction at the point of contact between rotating wheels 21 and rotating flanges 26. The other end of member 19 is fixedly mounted to cantilevered beam 22.

It is clear from the foregoing and FIGS. 3 and *3a* that roller 24 does not laterally constrain (either positionally or angularly) entering web W since it is capable of aligning itself so that its axis of rotation 23 is perpendicular to the direction of travel of entering web W as indicated by arrow 15. Hence, roller 24 presents no resistance to lateral movement of web W. The lateral position of flanges 26, on the other hand, remains fixed relative to back plate 60 (and, of course, relative to main machine frame 80). Thus, for small pivoting movement of roller 24 about castering axis 90 and gimbal axis 95, the lateral position of the web at roller 24 remains fixed even though the angle of the entering or exiting web may change. It is seen, then, that flanges 26 provide lateral positional stability for moving web W. Since roller 24 offers no lateral resistance to the entering web, and gimbal axis 95 enables the exiting web to change direction, no excess forces develop on the edges of web W and therefore, no damage can occur as long as the angles of the entering and exiting webs are within the tolerances of the castering and gimballing action of the roller.

It should be noted at this point that the significant features of web support 20 are (1) the opposed flanges mounted in a predetermined spatial relation to each other and to the machine frame 80, and (2) a web supporting cylindrical surface which presents substantially no resistance to the entering web. Clearly, there are numerous ways in accordance with the invention by which these features can be accomplished. For example, rather than a castered roller such as 24, an axially compliant roller could be utilized since such a roller would present no lateral resistance to the entering web W. Similarly, flanges, pins or other types of edge guides could be fixed relative to the machine frame in numerous ways. For a more thorough description of a non constraining web-engaging roller for a passive positionally constraining web support, see copending applications Ser. No. 504,777 and 504,778.

Returning now to FIG. 1, web support 30 is a fixed axis roller journalled for rotational movement on shaft 32 which is supported by front and back plates 70 and 60, respectively. Besides serving as an angularly constraining web support, web support 30 also drives web W about the path defined by supports 20, 30 and 40. The driving power is applied by a motor M and transmitted to the cylindrical drive roller 30 through drive belt 34 and pulleys 35 and 36. Of course, motor M is fixedly mounted to machine frame 80.

As noted earlier, web support 40 is an N type web support. Since it is also mounted for pivotal movement about a gimbal axis perpendicular to the entering web, the exiting web is free to change direction. As discussed earlier, an N support has many functional equivalents, the required characteristic being only that the entering web is not laterally constrained either positionally or angularly.

In the preferred embodiment, the non constraining feature is achieved by mounting a roller 44 for pivotal movement about a castering axis perpendicular to the plane of the entering web and located upstream of the roller, and about a gimbal axis parallel to the entering web W. This is more clearly seen in FIG. 4. Roller 44 is supported only at its midpoint by a self-aligning radial ballbearing 120 fixedly journalled on a linear motion ballbushing 122. Another suitable arrangement not shown could use a roller bearing and flexure disk. Thus, roller 44 is capable of both linear movement along shaft 124, which is carried by yoke 125, and pivotal movement about its midpoint. Flexure arm 140 limits the movement of roller 44 to pivotal movement about a castering axis 100 and a gimbal axis 105. One of end of flexure arm 140 is mounted to extension 126 of yoke 125 for three degrees of pivotal movement. The other end of flexure arm 140 is screwed to the outer surface of outboard bearing 150 for pivotal movement about a bend line 144 (seen more clearly in FIG. *4a*) which is perpendicular to the entering web and intersects axis of rotation 128. To offset the added weight of outboard bearing 150 and flexure arm 140 at one end of roller 44, counterweight 160 is added to the opposite end so that the roller is statically and dynamically balanced about its midpoint. Note that the center bores through bearing 150 and through counterweight 160 is larger than the diameter of shaft 124 to facilitate pivoting movement of roller 44 about axes 100 and 105.

Figure 4:
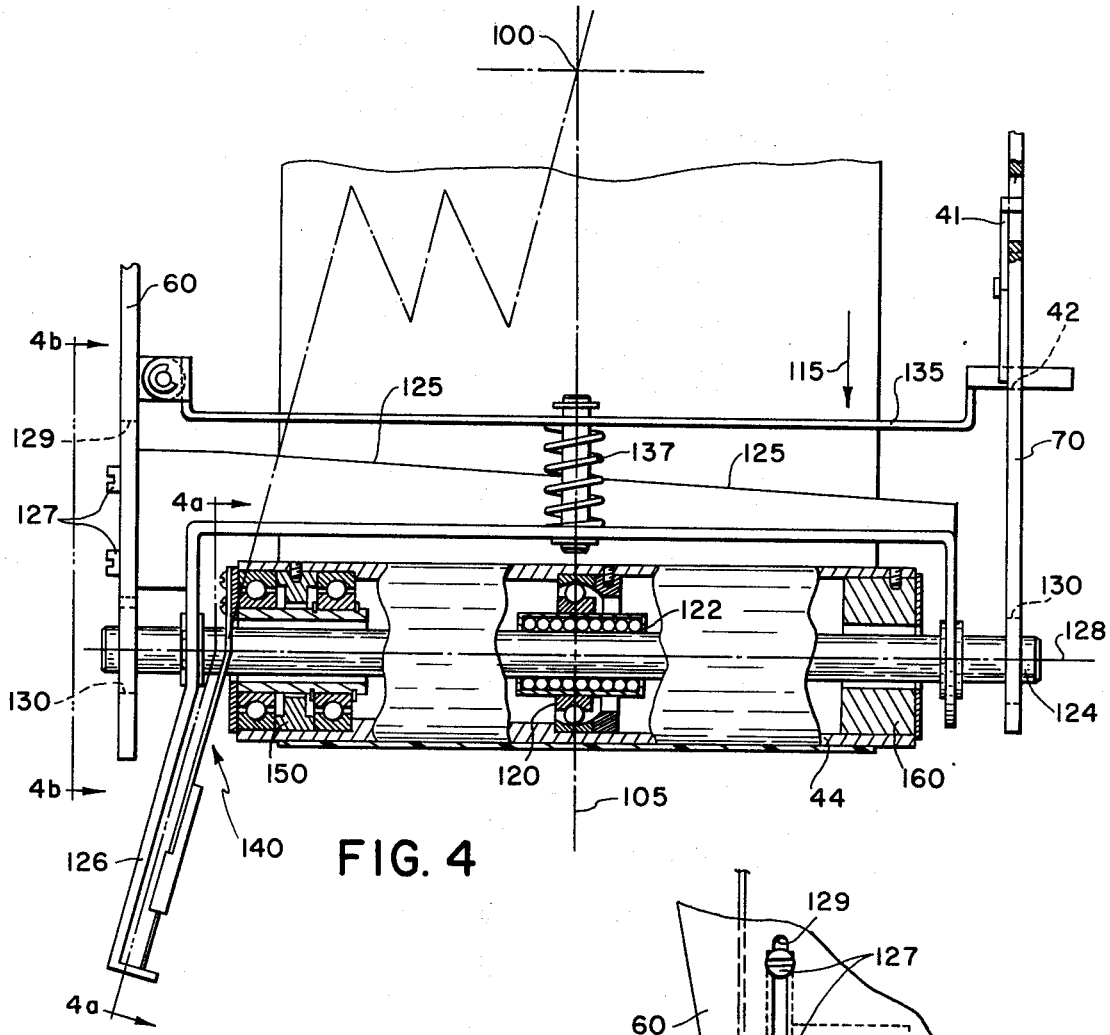
FIG. 4 is a plan, partly cut-away view of the non constraining web support of FIG. 1 taken along lines 4—4, showing the tension mechanism of the web tracking apparatus.
Figure 4A:
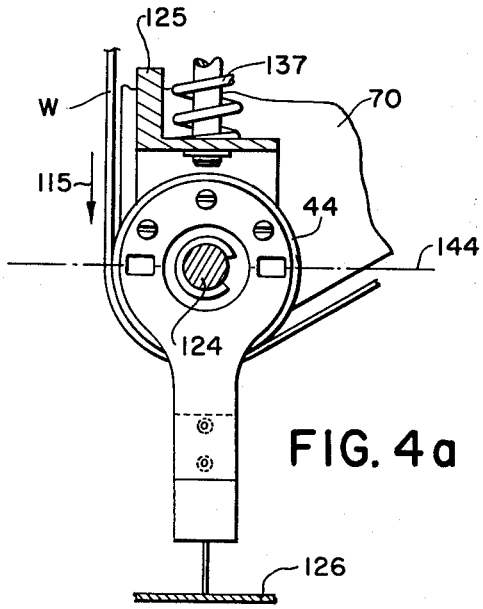
FIG. 4*a* is a side view of the FIG. 4 taken along lines 4*a*—4*a* showing the flexure arm of the non constraining web support.
Figure 4B:
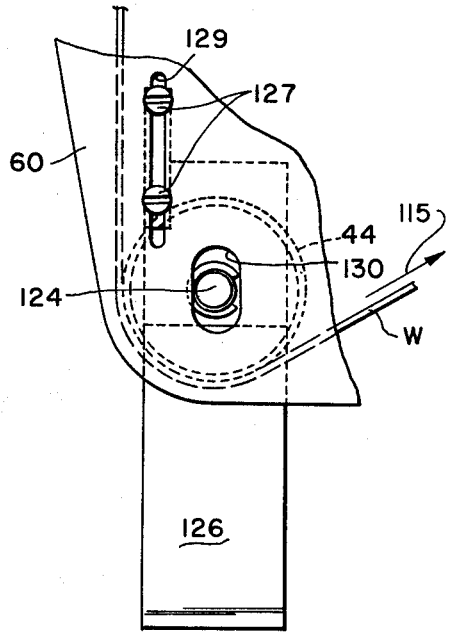
FIG. 4*b* is a side view of FIG. 4 taken along lines 4*b*—4*b* showing guiding slots in the back plate of the subframe.

It is clear from the foregoing and FIGS. 1 thru *4b* that, relative to yoke 125, roller 44 is capable of pivotal movement about castering axis 100 and gimbal axis 105 for small deviations from nominal (the nominal position being defined as the position wherein axis of rotation 128 is coincident with the axis of shaft 124 as shown in FIG. 4). Yoke 125 is spring biased against lever arm 135 by spring 137 which is under compression between bar 135 and yoke 125. Yoke 125 is slidably mounted to back plate 60 of subframe 61 by rivets 127 which extend through slot 129 of back plate 60. To further insure that yoke 125 (and consequently roller 44) will slide only in one direction, extensions of shaft 124 protrude through plates 60 and 70 and slide in respective slots 130 in the plates as shown more clearly in FIG. 2. Spring 137 applies the required tension on the moving web when lever arm 135 is in the lock position as shown in FIG. 1. To remove tension on the web and achieve sufficient slack in the closed-loop web to remove it from the web supports, lever arm 135 is placed in the unlocked position by releasing the locking mechanism 41 and permitting the lever to slide along slot 42 on front plate 70 (see FIGS. 1 and 2). Thus, web assembly 40 not only acts as a non constraining roller, but also as a tension roller to maintain the proper tension in the web W as the web moves in its closed loop path, and as the means for removing tension during replacement of the web.

In operation, the moving web entering web support 20 (a P support) is laterally constrained by flanges 26. Since roller 24 of web support 20 is capable of pivotal movement about castering axis 90 (FIG. 3) without disturbing the lateral position of flanges 26, the cylindrical roller 24 offers the entering web no resistance to lateral movement. Such resistance if encountered, would tend to produce non uniformities in web tension.

As the web exits from web support 20, it is free to pivot about gimbal axis 95. Since gimbal axis 95 is parallel to the entering web, pivoting of the roller about the gimbal axis to accommodate a condition in the exiting web will not disturb the position of the entering web; i.e., the direction of movement of the entering web remains perpendicular to the axis of rotation 23 of roller 24 during pivotal movement of roller 24 about gimbal axis 95. Thus the exiting web can change direction without disturbing the lateral position of the upstream web.

As the web exiting from web support 20 approaches fixed axis drive roller 30, (a laterally constraining web support of the A type) its angular position is fixed by fixed axis roller 30 since the entering web will align itself so that its direction of travel is perpendicular to the axis of rotation of roller 30. It should be noted that if the axis of rotation of roller 30 is askew relative to the axis of rotation of web support 20, the gimbal axis 95 of web support 20 will enable the web to change its direction until the web tracks into alignment with roller 30. This feature of the invention permits looser tolerances in the parallelism of the mounted web supports. It is also noted that the wrap angle is about 120° and the surface of the roller 30 is hard rubber, to develop sufficient friction between the web and the roller to promote tracking and to drive the web about the supports.

Since roller 30 has a fixed axis, the exiting web is constrained against changing direction. It is clear that to comply with the web tracking principles discussed above, the web exiting from the angular constraint 30 must be angularly decoupled once and only once before entering positional constraint 20. This becomes a requirement of the web tracking apparatus if uniformity of tension is important; it is not a requirement for lateral stability of the moving web since stability can be achieved without gimballing any of the web supports. As noted earlier, however, defiance of the "once and only once" rule can result in non uniformity of tension, possible edge damage, possible wrinkles, etc., although these undesirable effects can be minimized, for example, by increasing the precision in the parallelism of the mounted web supports and decreasing the manufacturing tolerances of the web and web support. Such alternatives, however, tend to be expensive in terms of economics, quality, and reliability of the final product.

The "once and only once" rule of the uniformity of tension principle is fulfilled by non constraining web support 40, which is also the tension roller of the apparatus. The web exiting from fixed axis roller 30, and approaching non constraining web support 40, does not see roller 44 as a lateral constraint since the roller 44 will pivot about castering axis 100 to remain in alignment with the entering web. Thus the axis of rotation of fixed axis roller 30 need be only "substantially" parallel to the axis of rotation of roller 44 when at nominal position, the degree of parallelism depending on the castering action of roller 44.

By gimballing non constraining web support 40 about gimbal axis 105, the exiting web is free to change direction, thereby angularly decoupling the web exiting from fixed axis roller 30; i.e., the exiting web is free to change direction to meet flanged web support 20 at whatever angle and lateral position it is relative to non constraining web support 40. It should be noted that the surface of roller 44 is polished aluminum and the wrap angle of the web about roller 44 is approximately 120°, which is in proper range for tracking and for gimballing. Since it is an N type roller, lateral slippage between the roller and the web will not be detrimental to its function since it is its function to present no lateral resistance to the entering web.

It is seen from the foregoing that the apparatus shown in FIG. 1 could be used for tracking many different kinds of flexible web but is particularly useful for tracking a photoconductive web in a xerographic copying apparatus (where tracking accuracy is essential without recourse to servo-steering mechanisms, without damage to the edges, and with uniformity of tension in the web. Moreover, once the web begins to move in the path defined by supports, it will remain aligned indefinitely, with substantially no lateral deviation occuring in the centerline position of the web, cycle to cycle.

It should be noted that it is a feature of the invention that a passive positional laterally constraining web support, such as support 20, in combination with any other type of constraining web supports, will produce a laterally stable web tracking apparatus. Moreover, if all the web supports are mounted substantially in parallel, a measure of uniformity of tension is also achieved. However, for best results, the web support chosen in combination with flanged positionally constraining web support 20 should follow the principles set out above.

Figure 5:
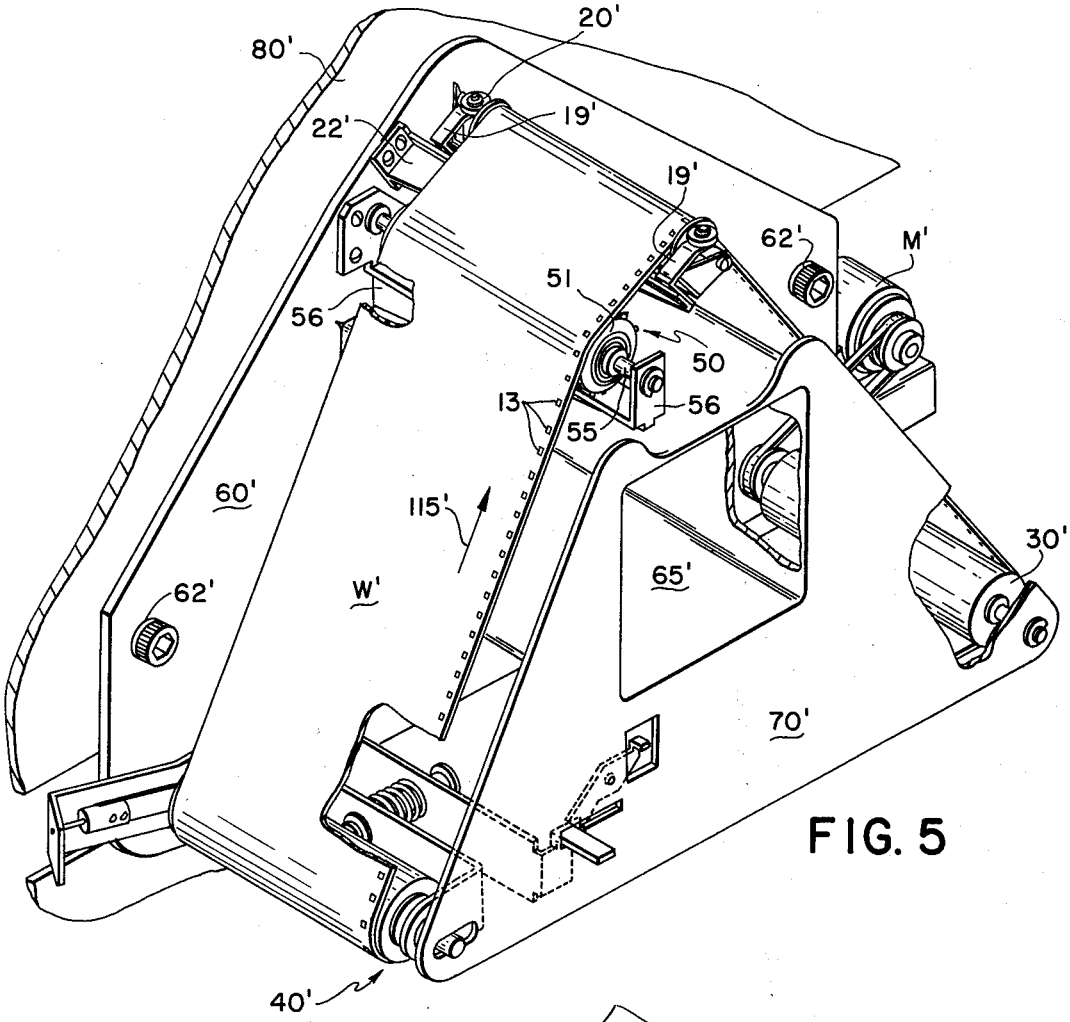
FIG. 5 is an isometric view of another embodiment of the invention showing the addition of a fourth web support to the tracking apparatus shown in FIG. 1.
Figure 6:
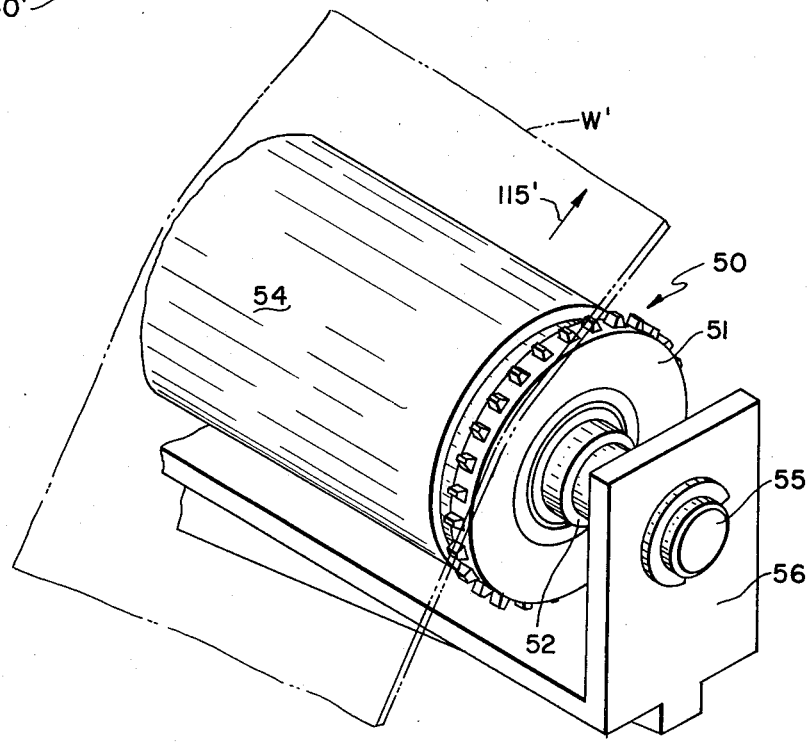
FIG. 6 is an enlarged, fragmentary, isometric view of the additional web support shown in FIG. 5 also showing a sprocket wheel on one side of the web support.
Figure 6A:
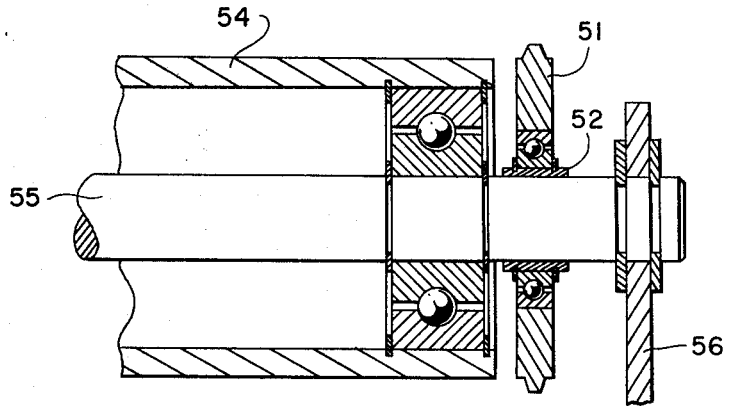
FIG. 6*a* is a fragmentary, cross-sectional view of the additional web shown in FIG. 5, showing the relationship between the web support and the sprocket wheel.

In keeping with such principles, a fourth web support may be added to the tracking apparatus as shown in another embodiment illustrated in FIG. 5. A comparison of FIGS. 1 and 5 will reveal that the two devices are identical except for the fourth web support 50 in the apparatus of FIG. 5, more clearly seen in FIG. 6. Web support 50 comprises a fixed axis roller 54 journalled on fixed shaft 55 which is fixedly mounted on cantilever beam 56. Cantilever beam 56 is bolted to back plate 60' which, in turn, is bolted to machine frame 80'. As seen more clearly in FIGS. 6 and 6a, sprocket wheel 51 is journalled on a ball bearing which is fixedly mounted onto sleeve bearing 52. Thus, it is seen that sprocket wheel 51 is capable of independent rotational and axial movement relative to fixed axis roller 54.

The surface of roller 54 is, for example, polished aluminum, and the wrap angle the web makes with the roller is approximately 30°. Ordinarily, this wrap angle would be sufficient for the phenomenon of tracking to take place and the roller would be a laterally constraining support of the A type. If so, the exiting web would have to be angularly decoupled by gimballing the roller for pivotal movement about an axis parallel to the entering web. Since it is a fixed axis roller, the exiting web does not have freedom to change direction. Thus, it conforms to the web tracking principles discussed above.

The sprocket wheel 51, which is decoupled from roller 54 and places very little drag on the tracking apparatus, engages the perforations 13 on the side of photoconductive web W and enables one to synchronize the various operations within the xerographic apparatus with web position so that, for example, the photoconductive web is not exposed at a splice.

Figure 7:
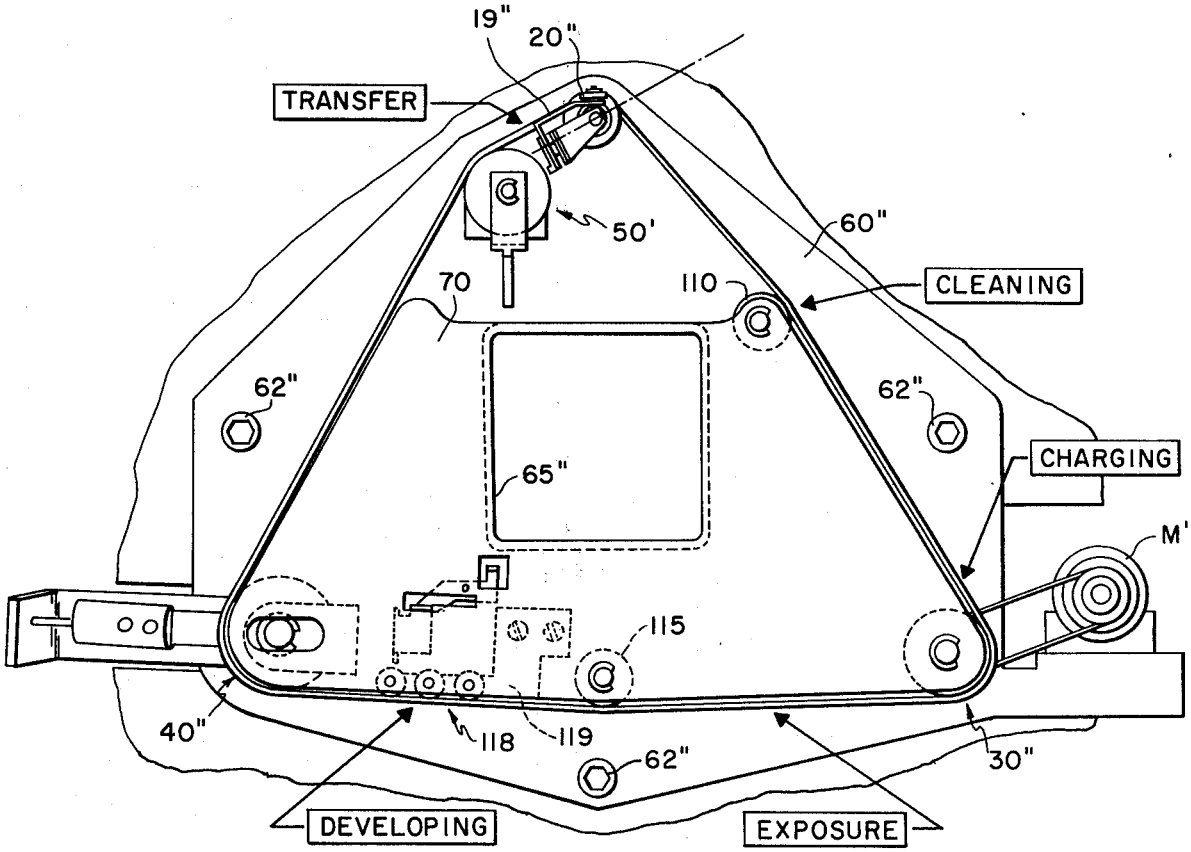
FIG. 7 is a plan view of another embodiment of the invention in which additional web supports have been included in the web tracking apparatus of FIG. 1, showing a photoconductive web moving through a plurality of work stations in which an electrophotographic process is implemented.

It is clear that any number of web supports may be used in the web tracking apparatus, and more than three web supports may be desirable in a xerographic apparatus where the photoconductive web moves through a plurality of stations such as exposure, developing, transfer, cleaning and charging stations, see FIG. 7. For example, in the embodiment shown in FIG. 7, in addition to the four web supports shown in FIG. 2, there is a cleaning station back-up roller 110, a stabilizer roller 115 and three ganged back-up rollers 118 opposite the developing station. The ganged back-up rollers 118 are mounted on blade flexure so that the rollers can pivot about an upstream castering axis perpendicular to the entering web. Thus, ganged back-up rollers 118 are non constraining N type rollers not gimballed. Such a mounting for the rollers 118 may be unnecessary, in view of the slight or absent wrap angle, in which case they would act as a non constraining support even without the blade flexure. The wrap angles of the web with fixed axis polished aluminum rollers 110 and 115 act as non constraining N type rollers, also not gimballed.

It is seen than that the web supports of FIG. 7 follow the web tracking principles enumerated above and achieve their lateral stability from the flanged, positionally constraining web support 20'.

The invention has been described in detail with particular reference to preferred embodiments thereof, but it will be understood that variations and modifications can be effected within the spirit and scope of the invention.

We claim:

1. A passive web tracking apparatus including a frame and web support means mounted on said frame for imparting lateral stability to a flexible web moving in a path, said web support means comprising:

a first web support disposed at a first location adjacent to the path, said first web support rotating in tracking engagement with the web and constraining the lateral position of the web at the first location; and a second web support disposed at a second location adjacent to the path and spaced upstream from the first location for constraining at the second location the lateral spatial position of the web, said second web support including a web supporting surface which rotates in tracking engagement with the web without imposing substantial lateral forces on the web regardless of the lateral angular position of the web in said apparatus.

2. A passive web tracking apparatus including a frame and web support means mounted on said frame for imparting lateral stability to a flexible closed loop web moving in a closed loop path, said web support means comprising:

a cylindrical roller disposed at a first location adjacent to the path and mounted for rotational movement about a longitudinal axis for angularly constraining the lateral angular position of the moving web at the first location, said longitudinal axis being fixed relative to said frame; and a web support disposed at a second location spaced along the path from the first location for constraining at the second location the lateral spatial position of the web without constraining the lateral angular position of the web, said web support having a) means for fixing the lateral spatial position of the web at the second location, and b) a web supporting surface which rotates in tracking engagement with the web and which permits changes in the lateral angular position of the web without imposing more than negligible lateral forces on the web.

3. A passive web tracking apparatus including a frame and web support means mounted on said frame for imparting lateral stability to a flexible closed loop web moving in a close loop path, said support means comprising:

a member disposed at a first location to rotate in supporting engagement with the moving web without gross slipping relative to the moving web, said member constraining the lateral angular position of the web at the first location; and a web support disposed at a second location spaced along the path from the first location for constraining at the second location the lateral spatial position of the web without constraining substantially the lateral angular position of the web, said web support having a) a cylindrical roller mounted to rotate in supporting engagement with the web, and for castering movement to align said cylindrical roller with the web with negligible resistance, and b) guide means for engaging the edges of the web at said second location to establish a fixed lateral spatial position of the web at the second location.

4. Passive web tracking apparatus including a frame and web support means mounted on said frame for imparting lateral stability and for maintaining uniform tension in a flexible closed loop web moving in a closed loop path, said support means comprising:

a first cylindrical roller disposed at a first location adjacent to the path and mounted for rotation substantially in non-slipping engagement with the web, said first roller supporting the web and determining the lateral angular position of the web at the first location; and a web support disposed at a second location spaced along said path from the first location for constraining at the second location the lateral spatial position of the web without significantly constraining the lateral angular position of the web, said web support having (a) a second cylindrical roller mounted (i) for rotating movement in supporting engagement with the web, (ii) for castering movement to align itself with the web without imposing substantial resistance to lateral angular movement of the web, and (iii) for gimballing movement to angularly decouple the web exiting from said web support to maintain uniformity of tension in the exiting web; and (b) edge guide means for engaging the edges of the moving web at the second location to establish the spatial lateral position of the web at the second location.

5. A passive web tracking apparatus including a frame and web support means mounted on said frame for imparting lateral stability to a flexible closed loop web moving in a closed loop path, said support means comprising:

a first web support including a rotatable member disposed at a first location adjacent to the path and mounted for rotating in supporting engagement with the web, said first support constraining lateral angular movement of the web at the first location;

a second web support disposed at a second location adjacent to said path for constraining at the second location the lateral spatial position of the web without constraining substantially the lateral angular position of the web, said second web support having (a) a second rotatable member mounted for rotating in supporting engagement with the web and for castering to align itself with the web without imposing substantial lateral forces on the web, and (b) edge guide means for engaging the edges of the moving web at the second location to establish a fixed spatial lateral position of the web at the second location; and a third web support disposed at a third location adjacent to said path downstream from the first location and upstream from the second location and including non-constraining means for engaging and supporting the web at the third position with uniformity of tension in the moving web.

6. The invention of claim 5 wherein said edge guide means comprise annular flanges mounted for rotational movement independent of the rotational and pivotal movement of said second rotatable member.

7. The invention of claim 5 wherein said third web support is a castered and gimballed cylindrical roller mounted for tracking the web.

8. The invention of claim 7 wherein said third web support is gimballed about an axis substantially perpendicular to and intersecting said third roller at its midpoint and extending in a plane substantially parallel to the plane of the moving web entering said third web support.

9. The invention of claim 8 wherein said third web support comprises means for resiliently urging said cylindrical roller into engagement with the moving web to maintain the moving web under tension.

10. A passive web tracking apparatus including a frame and web support means mounted on said frame for imparting lateral stability to a flexible closed loop web moving in a closed loop path, said web support means comprising:

a first web support disposed at a first position adjacent to and within the periphery of the path for driving the moving web in the path and for angularly constraining the lateral position of the moving web;

a second web support disposed at a second position adjacent to and within the periphery of the path upstream from the first position, for constraining at the second position the lateral spatial position but not the angular position of the moving web, thus imparting to the moving web freedom to change angular direction in response to changing downstream conditions, said second web support including (i) a web-engaging surface which rotates in supporting engagement with the web and which presents substantially no resistance to lateral movement of the moving web at the second position, and (ii) edge guide means mounted adjacent to said surface in a predetermined spatial relation to said frame and having spaced opposed web engaging portions a maximum fixed distance apart which corresponds substantially to the width of the moving web for engaging the edges of the moving web at the second position; and a third web support positioned adjacent to and within the periphery of the path downstream from the first position and upstream from the second position for engaging the web without laterally constraining the moving web, and for imparting to the moving web freedom to change direction, said third web support including a web engaging cylinder mounted to rotate gimbal and caster about mutually perpendicular axes.

11. The invention of claim 10 wherein, said web support means further comprises a fourth web support downstream of said third support and upstream of said second support for engaging without laterally constraining such moving web, and for preventing such moving web exiting from said fourth web support from changing angular direction, so that such moving web exiting from said first web support is free to change angular direction once only before entering said second web support.

12. Passive tracking apparatus in an office copier for establishing a path of movement of an endless photoconductive web relative to a plurality of processing stations located to act on the web, said apparatus comprising:

a frame; and a plurality of web engaging members consisting exclusively of a first web support, a second web support, and other web engaging members, said web engaging members maintaining substantially uniform tension in said web, and determining the spatial lateral position and the angular lateral position of said web relative to said frame throughout said path of movement;

said first web support being disposed at a first location and rotatably engaging said web to determine the lateral angular position of said web;

said second web support being disposed at a second location spaced along said path of movement from the first location and rotatably engaging said web to determine the lateral spatial position of said web without constraining the lateral angular position of said web; and said other web engaging members engaging said web without constraining the lateral angular or spatial position of said web.

13. Passive web tracking apparatus as claimed in claim 12, wherein said first web support drives said web in said path of movement.

14. Passive tracking apparatus in an office copier for establishing a path of movement of an endless photoconductive web relative to a plurality of processing stations, said apparatus comprising:

a frame;

first, second and third web engaging members for maintaining substantially uniform tension in said web, and determining the lateral spatial position and the lateral angular position of said web relative to said frame, throughout said path of movement;

said first web support being disposed at a first location and rotatably engaging said web to determine the angular lateral position of said web;

said second web support being disposed at a second location spaced from the first location along the path of movement and rotatably engaging said web to determine the lateral spatial position of said web without constraining the angular lateral position of said web; and said third web engaging member engaging said web to tension said web without constraining the lateral angular or spatial position of said web.

* * * * *